US005695134A

United States Patent [19]

Williams

[11] Patent Number: 5,695,134

[45] Date of Patent: Dec. 9, 1997

[54] MATERIAL REDUCING HAMMER MILL WITH INTERNAL AIR CIRCULATING FAN

[76] Inventor: Robert M. Williams, 16 La Hacienda, Ladue, Mo. 63124

[21] Appl. No.: 629,825

[22] Filed: Apr. 10, 1996

[51] Int. Cl.[6] ..... B02C 13/288

[52] U.S. Cl. ..... 241/48; 241/56; 241/156.3

[58] Field of Search ..... 241/275, 189.1, 241/55, 56, 48, 193, 186.3

[56] References Cited

U.S. PATENT DOCUMENTS 730,503 6/1903 Williams .
1,902,721 3/1933 Reyonlds .
2,785,865 3/1957 Berling ..... 241/186
3,472,379 10/1969 Lainas et al. .
3,643,879 2/1972 Palyi .

*Primary Examiner*—Mark Rosenbaum
*Attorney, Agent, or Firm*—Polster, Lieder, Woodruff & Lucchesi, L.C.

[57] ABSTRACT

Material reducing rotary mill for receiving paper material, or the like, from a first chamber and forcibly delivering the reduced material into a second chamber for discharge at an outlet, a bypass passage interconnecting the first and second chamber, and an air moving fan as an integral portion of the mill rotor that creates a closed air circulation loop to assure the movement of material from the first chamber through the rotary mill to the second chamber and the outlet.

6 Claims, 2 Drawing Sheets

MATERIAL REDUCING HAMMER MILL WITH INTERNAL AIR CIRCULATING FAN

BACKGROUND OF THE INVENTION

This invention is directed to a system of preparing paper material such as mixed paper goods, corrugator tubing, paper slabs and similar material to be shredded and baled for shipment to users of such material.

BRIEF DESCRIPTION OF THE PRIOR ART

Apparatus for reducing paper material by grinding or shredding to prepare that material for incorporation in bales presents problems of controlling the paper to prevent it being fluffed up and therefore rendered difficult to effectively reduce to a uniform size for baling or for other desirable uses. The paper material may comprise plain paper, cardboard and similar materials having a fibrous texture in which the characteristics vary generally from heavy or dense stock to light weight envelope and sheet stock. In handling such varied material, there is a problem of how to maintain the material so it moves in a controllable stream. The closest apparatus which directs material through a hammer rotor has recognized that a fan when incorporated in the rotor can assist in establishing a controllable stream flow of material without regard to the character of the material.

BRIEF SUMMARY OF THE INVENTION

The invention is directed to providing a more efficient apparatus for handling paper materials so that the reduction thereof by grinding is improved.

A further object of the invention is directed to housing a hammer rotor such that when the rotor has its own fan incorporated therein, the housing for handling air flow can be controlled so it is capable of moving the paper in the housing to control the flow of the material depending on its characteristic response to air flow.

Another object of the invention is to provide a hammer rotor with its own fan operable in a housing such that the housing is able to recirculate air in a closed loop to sweep the paper material through the rotor and assure that substantial quantities of the material being fed into the mill is ground by the rotor.

A further object is to provide a movable baffle in a material receiving chamber to bypass certain types of paper items that may not require reduction in the mill rotor.

Other objects of the invention will be set forth and described in connection with the details of apparatus shown in the drawings.

BRIEF DESCRIPTION OF THE DRAWINGS

The best mode of practicing the invention is shown in the drawings as follows.

DETAILED DESCRIPTION OF THE EMBODIMENT

Figure 1:
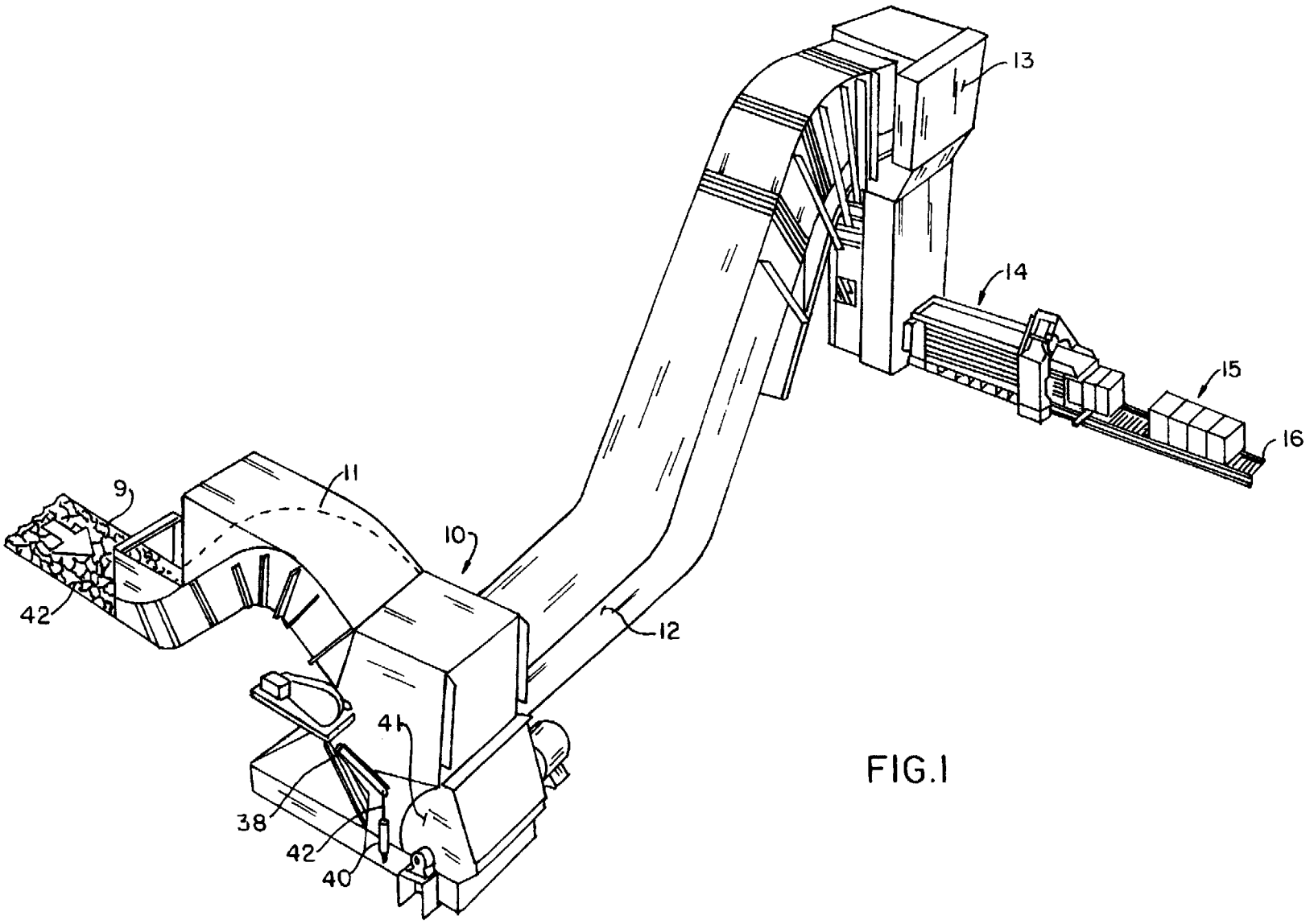
FIG. 1 is a schematic perspective view of the components of apparatus consistent with the intent of the apparatus for carrying out the invention.

The view of FIG. 1 discloses the housing structure 10 which contains the hammer rotor and fan combination for processing paper material being supplied to the housing structure on a suitable conveyor 9 to deliver paper material to the housing enclosure 11 associated with the conveyor. The paper material being processed in the housing structure 10 is first discharged to a suitable conveyor enclosed in housing structure 12. The processed material is carried through that enclosed structure 12 into the top of a vertically directed tower 13 which is adapted to feed the processed material into a suitable compactor 14 which extends outwardly from the tower 13 to discharge material that has been compressed into bales 15 which can be collected from conveyor 16. While baling may be primary, the apparatus is not so limited.

Figure 2:
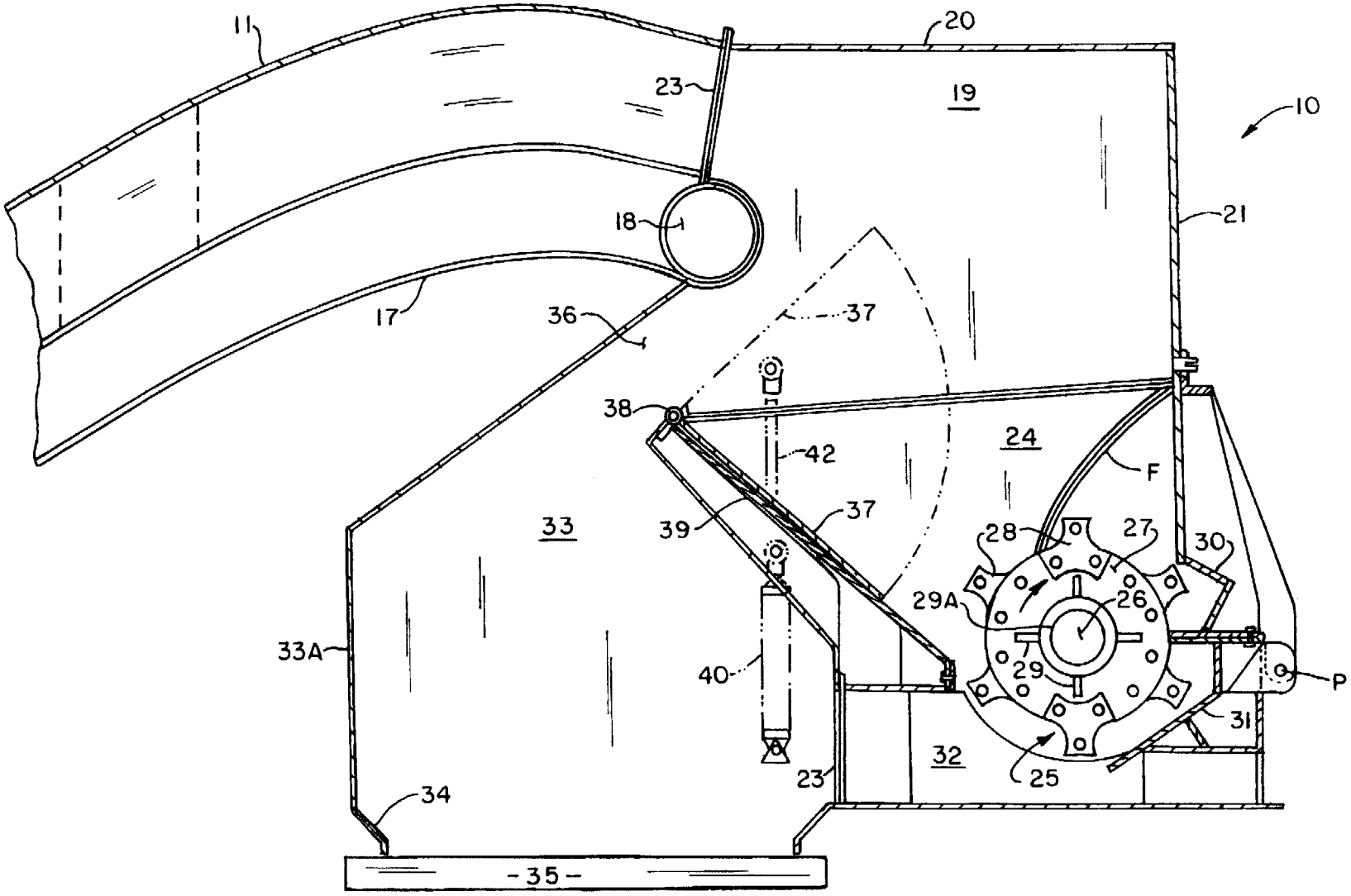
FIG. 2 is an enlarged vertical sectional view of the rotary hammer and fan apparatus and its associated housing structure to illustrate the air and paper circulation in the mill housing.

Turning now to FIG. 2, the details for the delivery end of conveyor 42 is an inlet housing 11 which is suitable for handling the contents operating in housing 10. The housing is disclosed as follows. The conveyor 17 trained over the head shaft 18 deposits the paper material into the receiving chamber space 19 enclosed by a suitable wall structure 20 and 21. The housing 11 for enclosing the conveyor 17 is connected to the space 19 along abutting flanges 23 which do not obstruct the passage of material.

The housing 10 is part of an enclosure 24 for the hammer rotor 25 which is carried on a shaft 26. The hammer rotor 25 is made up of a series of discs 27 carried in the usual longitudinal spaced relation along shaft 26 to allow for the attachment of hammers 28. The spacing of discs 27 allows for the incorporation of fan blades 29 set on supporting hubs 29A between the discs 27. The material entering the enclosure 24 is processed by the hammers 28 sucking that material into the rotor assembly by the fan blades 29. That material is forcibly thrown against the wall structures 30 and 31 by the hammers before being propelled through the outlet passage 32 to enter into the enlarged chamber 33 at approximately the speed of the hammers 28.

The material thrown into chamber 33 and slammed against the wall 33A thereof consists of a mixture of paper material having a variety of weights. Since the space 33 allows the material to loose some velocity, it falls out of the outlet opening 34 of chamber 33 and is caught on a suitable conveyor 35 which is directed to extend through the housing 12 seen in FIG. 1. While the material is free to fall onto the conveyor 35, the air flow generated by the fan blades 29 is free to follow a closed loop through bypass 36 and return to the chamber 19 where it can recirculate back to the rotor 25. That air closed loop recirculation accomplish a number of functions. It can propel the material into the rotor 25, it can also act on the material that is thrown back into the space 19 by the direction of the rotor hammers 28, and that flow of air through the bypass 36 can keep the material from accumulating in space 19 by forcing said light material down into the rotor 25. It is to be noted that the access to the rotor 25 is obtained by having the housing structure formed with a butting flanges F so that the wall structure 30 can be pivoted at P to open the enclosure 24 when necessary. Having the internal bypass 36 eliminates the need for any external fan arrangement because the flow of the air is caused to be drawn through the bypass opening 36 to reenter the space 19 where it picks up the incoming material from the conveyor 17 and circulates it into the rotor 25.

The foregoing apparatus is characterized by a first chamber 19 receiving the material from conveyor 17, a second chamber 33 having an outlet 34, a bypass 36 connecting the first and second chambers, and the rotary grinder for withdrawing the material from the first chamber 19 and delivering the ground paper to the second chamber and outlet 34 while the air circulation generated by a fan 29 creates a close air circulation loop through the bypass 36 between the first and second chambers.

As noted above, some paper material does not need to be reduced so it can be intercepted by raising the gate 37 while the rotor 25 is in operation to momentarily interrupt such material when necessary. That gate 37 normally rests on the wall 39 of space 24. A suitable hydraulic or pneumatic motor cylinder 40 mounted in pairs on the exterior walls 41 (one bearing seen in FIG. 1) of the housing 10. The reciprocating piston rod 42 connected to the pivot shaft 38 of gate 37 is adapted, at a suitable time, to effect pivoting movement of the gate 37 to its broken line positions so it is positioned to intercept the incoming light weight portions of the material out of the space 19 and into the chamber space 33. Thus the light weight material is steered through the bypass opening 36 to join the material thrown into the space 33 by the rotor 25 and is effectively prevented from gathering in the space 19. When the incoming material is light and tends to float, the fan blades 29 pull that material into the hammer rotor, and the recirculating air in bypass 36 aids that result.

The paper material brought to the housing structure is first directed through a shredder (not shown) which reduces the material into desirable particle sizes 42 (See FIG. 1) that are conveniently further shredder by the hammer 28 on rotor discs 27 to a size condition suitable to be collected as desired, or to be compressed into bales 15. The resulting material output can be shipped, for example, to places where volume operations producing recycled finished paper can be accommodated.

The foregoing disclosure has provided a desirable apparatus for processing all types of paper products. The apparatus is also able to control the paper material that is light weight and sensitive to air flow currents so that effective means has been successfully combined to improve the capacity of material that passes through the apparatus.

Modifications to accomplish the objects of the invention are to be included in the scope of that invention.

What is claimed is:

1. Apparatus for processing paper materials comprising the combination of:

a) first chamber forming means having an entry to receive paper materials;

b) second chamber forming means having an outlet and a passage forming means connected into said first chamber;

c) paper material rotary grinder connected to said first chamber and to said second chamber, said grinder withdrawing paper material from said first chamber and forcing said paper material into said second chamber for passage to said outlet; and d) air moving fan combined with said material rotary grinder to generate a closed loop air circulation from said second chamber through said passage forming means into said first chamber, said closed loop air circulation moving paper material into said grinder and forcibly into said second chamber for discharge at said outlet.

2. The apparatus set forth in claim 1 wherein gate means operably associated with said rotary grinder for movement into a position to intercept paper material received in said first chamber and redirect it through said passage into said second chamber in bypass of said rotary grinder.

3. The apparatus set forth in claim 1 wherein said rotary grinder is disposed in a separate enclosure.

4. The apparatus set forth in claim 1 wherein said fan is carried by said rotary grinder.

5. Apparatus for processing paper materials of variable character comprising the combination including:

a) a first chamber for receiving paper materials of variable character;

b) grinding rotor and fan operatively mounted adjacent said first chamber and having an outlet;

c) a second chamber adjacent said first chamber and having an inlet connected to said outlet, and an outlet;

d) a passage interconnecting said first and second chambers to form a loop passage between said chambers; and e) a movable baffle in said first chamber positionable to establish an air flow into said first chamber from said second chamber to force paper material in said first chamber into said grinder.

6. Apparatus for processing paper materials of light weight and heavier weight, said apparatus comprising:

a) a first chamber for receiving both light weight and heavier weight paper material;

b) a second chamber in open communication with said first chamber and having a paper outlet;

c) grinding rotor and fan operatively mounted adjacent said first chamber with an inlet open to said first chamber and an outlet open to said second chamber; and d) baffle means operatively movable in said first chamber between a first position to intercept light weight paper and direct it into said second chamber in bypass of said grinding rotor and fan, and another position to direct air flow from said second chamber into said first chamber to propel paper material into said grinder.

* * * * *